US008961272B2

(12) United States Patent
Timcke et al.

(10) Patent No.: US 8,961,272 B2
(45) Date of Patent: Feb. 24, 2015

(54) GRINDING DEVICE WITH PROTECTIVE HOOD

(75) Inventors: Arne Timcke, Alfdorf-Brech (DE); Winfried Biller, Stuttgart (DE); Oliver Stephan, Winterthur (CH); Philipp Mueller, Oberaach (CH)

(73) Assignee: C. & E. Fein GmbH (DE)

( * ) Notice: Subject to any disclaimer, the term of this patent is extended or adjusted under 35 U.S.C. 154(b) by 693 days.

(21) Appl. No.: 13/223,653

(22) Filed: Sep. 1, 2011

(65) Prior Publication Data

US 2012/0052779 A1 Mar. 1, 2012

(30) Foreign Application Priority Data

Sep. 1, 2010 (DE) ..... 10 2010 044 613

(51) Int. Cl.
*B24B 23/02* (2006.01)
*B24B 55/05* (2006.01)
*B24B 55/04* (2006.01)

(52) U.S. Cl.
CPC ..... *B24B 23/022* (2013.01); *B24B 55/04* (2013.01); *B24B 55/05* (2013.01)
USPC ..... 451/358; 451/359; 451/360; 451/451; 451/457

(58) Field of Classification Search
CPC .... B24B 55/05; B24B 55/052; B24B 55/055; B24B 55/057; B24B 55/04; B24B 27/08; B24B 23/022; B24B 45/00; B24Q 11/08
USPC ..... 451/354, 355, 356, 357, 358, 359, 360, 451/451, 452, 455, 457; 83/440.2, 546; 144/251.1, 251.2, 251.3, 252.1
See application file for complete search history.

(56) References Cited

U.S. PATENT DOCUMENTS

| | | | | |
|---|---|---|---|---|
| 1,089,022 | A | 3/1914 | Thompson | |
| 4,977,708 | A | 12/1990 | Kloft | |
| 5,766,062 | A | 6/1998 | Edling | |
| 7,131,897 | B2 | 11/2006 | Crover | |
| 8,523,640 | B2 * | 9/2013 | Esenwein | 451/451 |
| 2005/0215186 | A1 * | 9/2005 | Stierle et al. | 451/359 |
| 2010/0178857 | A1 * | 7/2010 | Esenwein | 451/359 |

FOREIGN PATENT DOCUMENTS

| | | | |
|---|---|---|---|
| DE | 3742430 | A1 | 6/1989 |
| DE | 3841644 | A1 | 6/1990 |
| DE | 69704394 | T2 | 10/2001 |
| EP | 0812657 | A1 | 12/1997 |
| WO | 2004087377 | A1 | 10/2004 |

OTHER PUBLICATIONS

German Search Report; Application No. DE 10 2010 044 613.0; Issued: Apr. 6, 2011; 4 pages.

* cited by examiner

*Primary Examiner* — Timothy V Eley
(74) *Attorney, Agent, or Firm* — St. Onge Steward Johnston & Reens LLC

(57) ABSTRACT

A grinding device is specified, comprising a housing in which a tool spindle for driving a tool is mounted, comprising a protective hood which can be locked on the housing, and comprising means which allow the tool spindle and the protective hood to be locked. An actuating device is provided which is displaceable on the housing between a first position in which the tool spindle is released and the protective hood is locked against rotation and a second position in which the tool spindle is locked against rotation and the protective hood can be adjusted in the angular position thereof on the housing.

20 Claims, 5 Drawing Sheets

GRINDING DEVICE WITH PROTECTIVE HOOD

CROSS REFERENCES TO RELATED APPLICATIONS

This application claims priority from German patent application 10 2010 044 613.0, filed on Sep. 1, 2010. The entire content of this priority application is incorporated herein by reference.

BACKGROUND OF THE INVENTION

The invention relates to a grinding device, comprising a housing in which a tool spindle for driving a tool is mounted, comprising a protective hood which can be locked on the housing, and comprising means which allow the tool spindle and the protective hood to be locked.

Such grinding devices are known in principle in the prior art.

There are also embodiments of such grinding devices in which the tool spindle together with the tool is accommodated on an extension arm on the actual drive, which is connected to the tool spindle via a belt drive in the housing of the extension arm (cf. DE 38 41 644 A1).

In this case, the rotary movement of the drive motor is transmitted to a belt pulley of the extension arm via the angular gear unit. Likewise located at the other end of the extension arm is a belt pulley which is coupled to the actual tool spindle, to which a tool, for instance a grinding disc, is fastened.

In addition, such devices have an adjustable protective hood, which is intended to keep flying sparks away from the operator, and a spindle lock. Although the drive machine itself often already has a spindle lock, the spindle should be capable of being locked on the extension arm, since otherwise the belt drive could slip during the tool change.

Therefore, in addition to the switch for activating the motor, such grinding devices also have two important actuating devices: on the one hand a device for locking the tool spindle and on the other hand a device for locking the protective hood in the desired working position.

In addition, it is desirable that the protective hood cannot be released from the housing in the position in which it can be rotated, since otherwise the protective hood could fall down unintentionally. There is therefore also a third actuating device, namely for releasing the protective hood from the housing.

In view of this it is a first object of the invention is to disclose an improved grinding device which permits simplified operation.

It is a second object of the invention to disclose a grinding device which is particularly suited as a fillet weld grinding machine.

It is a third object of the invention to disclose a grinding device with a protection hood that can be detached.

It is a forth object of the invention to disclose a grinding device with a protection that can adjusted into different angular positions and locked in different angular positions.

It is a fifth object of the invention to disclose a fillet weld grinding device that be easily used.

SUMMARY OF THE INVENTION

According to a first aspect these and other objects are achieved by a grinding device, comprising:

a housing;

a tool spindle received within said housing for driving a tool;

a protective hood which can be locked on said housing;

a locking arrangement engaging said tool spindle and said protective hood for selective locking; and an actuating device arranged is on said housing displaceably between a first position in which said tool spindle is released and said protective hood is locked against rotation, and between a second position in which said tool spindle is locked against rotation and said protective hood can be angularly adjusted on said housing.

The object of the invention is achieved in this way.

According to the invention, an actuating element displaceably mounted on the housing makes it possible both to release the tool spindle and lock the protective hood against rotation in the first position and to lock the tool spindle against rotation with simultaneous adjustability of the protective hood in the second position. This can be achieved according to the invention by a single actuating device. The actuating device therefore interacts with both the tool spindle and the protective hood in order to ensure, in the first position, release of the tool spindle and locking of the protective hood against rotation and in order to permit, in the second position, locking of the tool spindle against rotation and adjustability of the protective hood in the angular position.

In this way, much easier actuation in conjunction with a simplified construction is ensured.

In a further configuration of the invention, the actuating device also has a third position in which the protective hood can be released from the housing. In this position, the tool spindle can be freely rotatable or can also be locked against rotation.

For the operator, this third position differs noticeably from the first and second positions, such that release of the protective hood is possible only in this third position. This third position may be, for example, an intermediate position between the first and the second positions, in which third position the actuating device is located in a certain position. On the other hand, this third position could also be reached, for example, by another movement of the actuating device, such as, for instance, by a lateral movement, by overcoming a relatively powerful spring or in some other way. In this way, the protective hood can be released from the normal locking and then removed from the housing.

Much easier actuation of the grinding device is obtained overall. The grinding device can be grasped and held with one hand on the extension arm, i.e. on the housing on which the drive belt runs. The actuating device can be operated with one finger of the holding hand. The second hand remains free for releasing the tool or for adjusting or removing the protective hood.

In an advantageous development of the invention, the actuating device has a slide which is displaceably accommodated on the housing and which is displaceable between the first position, in which the slide acts on the protective hood in order to lock the latter against rotation, while the tool spindle is released, and the second position, in which the tool spindle is locked against rotation and the protective hood can be adjusted in the angular position thereof on the housing.

The possibility of changing over between the two positions can be realized in an especially simple manner through the use of a slide which is displaceable between the first and the second positions.

To this end, the slide can have, for example, a first projection which acts in the second position on the tool spindle in order to lock the latter against rotation, a second projection, furthermore, being provided on the slide, said second projection acting in the first position on the protective hood in order to lock the latter against rotation.

Thus, on the one hand, locking or release of the tool spindle and, on the other hand, release or rotation of the protective hood can be made possible in a simple manner through the use of two projections on the slide.

In an additional development of this embodiment, at least one locking element on the tool spindle is assigned to the first projection in order to ensure locking of the tool spindle in the second position.

In this way, not only frictional locking but also positive locking of the tool spindle can be ensured in order to achieve especially reliable locking of the tool spindle against rotation.

Furthermore, according to a further embodiment of the invention, a plurality of recesses in the protective hood are assigned to the second projection, in which recesses the second projection can be latched in various angular positions in order to ensure locking of the protective hood in the first position.

A means of adjusting the protective hood in various angular positions can thus be achieved in a simple manner.

According to a further configuration of the invention, the first projection and the second projection project from the slide in different directions.

A changeover between the first position and the second position can thus be achieved by a single movement of the slide, that is to say a combined changeover between locking of the protective hood with simultaneous release of the tool spindle on the one hand and locking of the tool spindle with simultaneous release of the protective hood on the other hand.

In this way, the two functions, namely release of the tool spindle and locking of the protective hood in the first position and locking of the tool spindle with simultaneous release of the protective hood for rotating in the second position, can be achieved in an especially simple manner by displacing the slide.

In a further configuration of the invention, the slide is moved into the first position in a preloaded manner by a preloading means, in particular by a spring.

In this way, the slide is regularly in the first position, and so the tool spindle is freely rotatable and the protective hood is locked. It is not until the slide is actively actuated against the action of the spring that the actuating device can thus be shifted into the second position.

In a further configuration of the invention, the slide has an insert made of a strengthened material, in particular steel, on which the first projection is formed.

Furthermore, the slide can be made of plastic, in which case the second projection can be formed in one piece with the slide.

Simple and cost-effect production of the slide from plastic is made possible by these measures, and at the same time wear of the first projection caused by engagement on the tool spindle is avoided.

According to a further configuration of the invention, a guide lane is provided on the protective hood, from which guide lane recesses project radially outwards and at which at least one aperture is provided in the circumferential direction, said aperture allowing the guide lane to be released from the second projection by rotation of the protective hood when the slide is in the third position in order to allow the protective hood to be removed.

In this way, release of the protective hood is made possible in an especially simple manner when the slide is located in the third position. This third position may be, for example, an intermediate position between the first and the second positions. In the third position, the second projection is released from the recesses in the radial direction, such that the protective hood can be removed by rotation when the second projection is in alignment with the aperture in the circumferential direction.

According to a further embodiment of the invention, the slide has an actuating button which can be actuated from outside via an aperture in the housing.

In this way, the actuating device can be activated in a simple manner by engaging the actuating button in the aperture in the housing.

In this case, the actuating button is preferably arranged in such a way that inadvertent actuation is not possible. To this end, the actuating button can lie, say, within the housing contour, that is to say it can be reached, but it does not project beyond said housing contour.

According to a further embodiment of the invention, guides on the housing are assigned to the slide, said guides allowing the slide to be displaced in the radial direction of the tool spindle.

In this way, the slide is reliably guided between the first and the second positions and is locked against rotation.

As already mentioned above, the tool spindle can preferably be driven via a belt drive, the grinding device preferably being designed as a fillet weld grinder.

It goes without saying that the abovementioned features and the features still to be explained below can be used not only in the respectively specified combination but also in other combinations or on their own without departing from the scope of the present invention.

BRIEF DESCRIPTION OF THE DRAWINGS

Further features and advantages of the invention can be gathered from the description below of preferred exemplary embodiments with reference to the drawing, in which.

DESCRIPTION OF PREFERRED EMBODIMENTS

Figure 1:
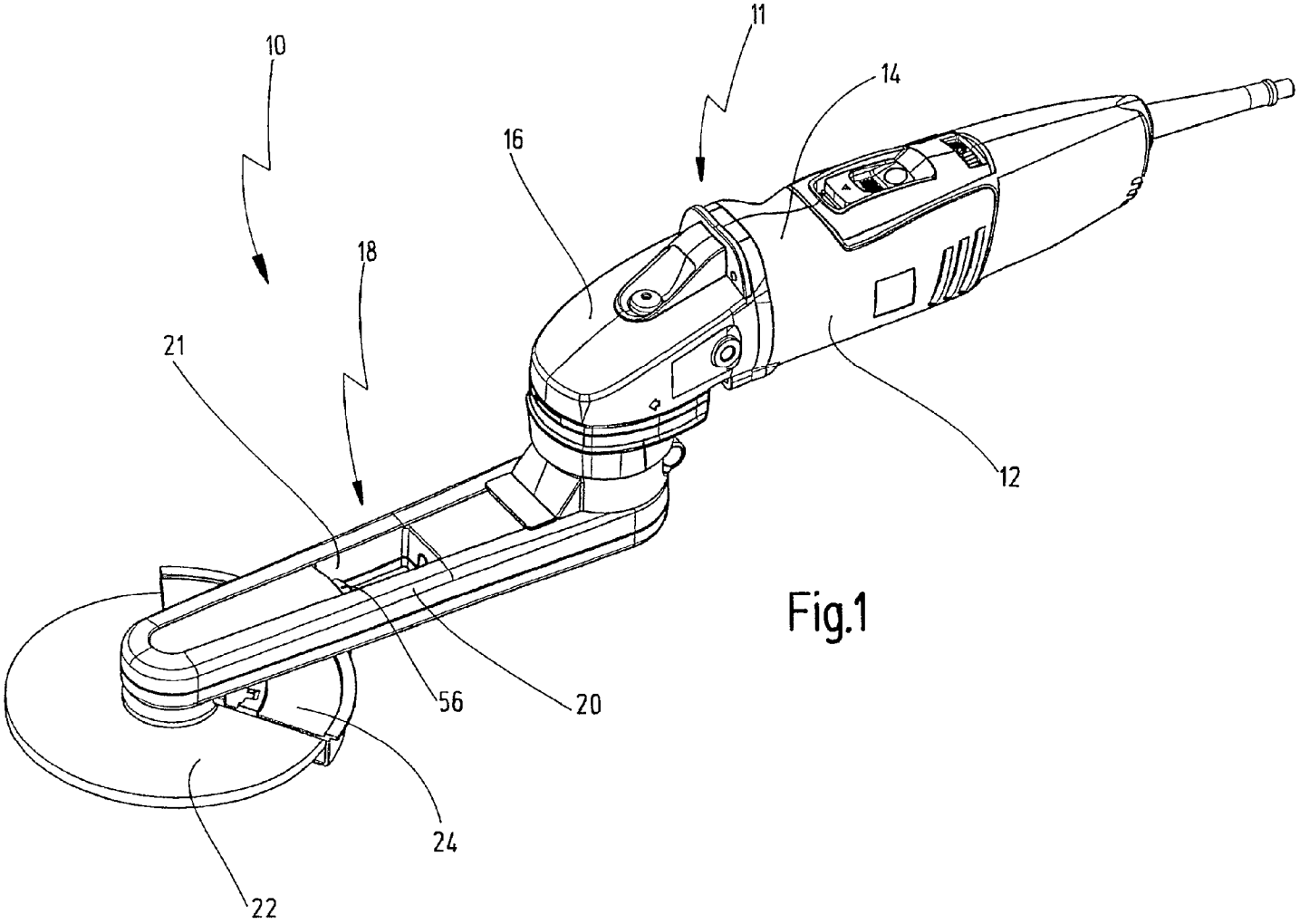
FIG. 1 shows a perspective view of a grinding device according to the invention.

A grinding device according to the invention is shown in a perspective view in FIG. 1 and is designated overall by the numeral 10.

The grinding device 10 has a drive 11 in the form of an angle grinder drive, having a handle 12 in which a motor 14 is accommodated and on which a gear unit 16 in the form of an angular gear unit is flange-mounted. Accommodated on the outer end of the gear unit 16 is an elongated extension arm 18 which is enclosed by a housing 20. A tool spindle, in which a tool 22 in the form of a grinding or cut-off tool is clamped in place, and a protective hood 24, which is accommodated in such a way that it can be shifted into various positions, are located on the outer end of the extension arm 18. An aperture 21, into which a finger can reach, is provided approximately in the centre of the extension arm 18 in the housing 20.

A belt drive which transmits the output movement of the gear unit 16 of the drive 11 to the tool spindle is accommodated in the extension arm 18.

Such a grinding device can be used in particular as a "fillet weld grinder".

The grinding device 10 has an actuating device (cf. FIG. 2) which is designated overall by 32 and which can be activated via an actuating button 56 when a finger reaches into the aperture 21 in the housing 20. Locking of the tool spindle and of the protective hood and removal of the protective hood in certain respective positions can be controlled with the actuating device 32.

Figure 2A:
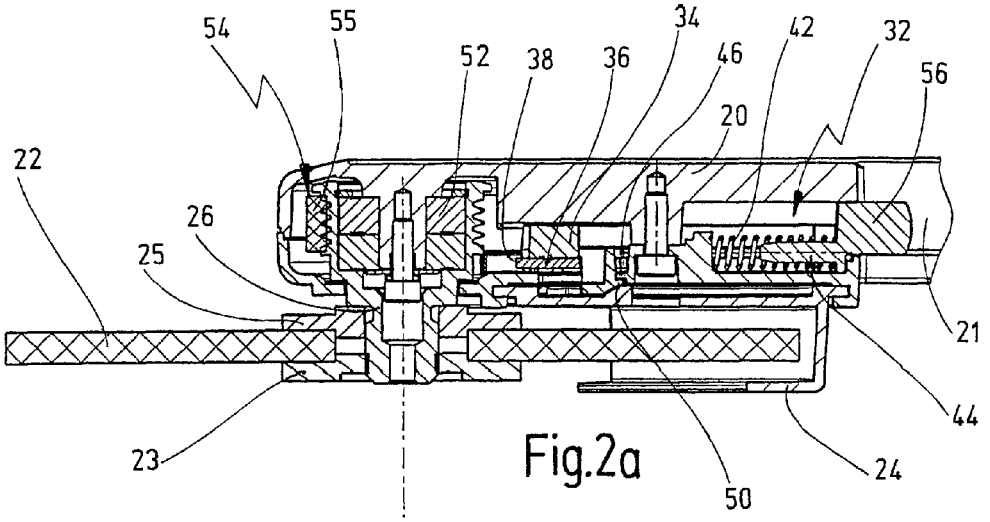
FIG. 2*a* shows a partial cross section of the grinding device according to FIG. 2.
Figure 2:
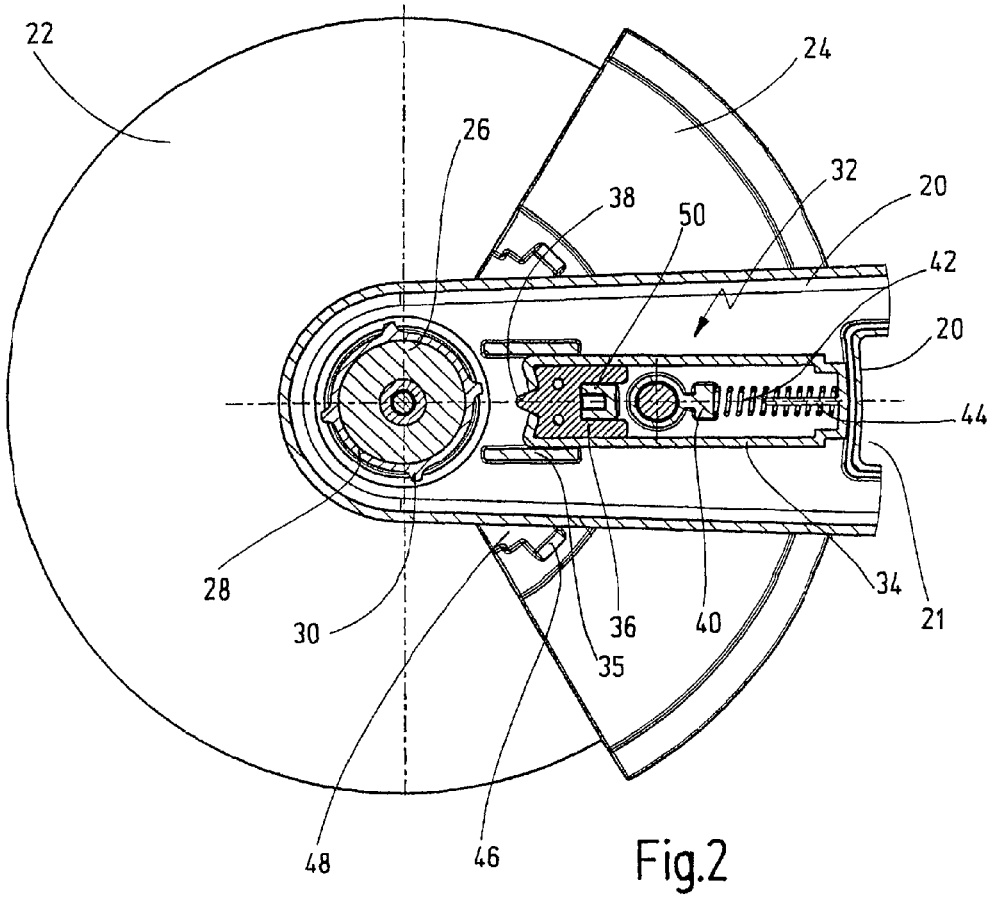
FIG. 2 shows a partial longitudinal section through the grinding device according to FIG. 1 in the region of the tool spindle and of the protective hood, specifically in a first position in which the drive spindle is freely rotatable and the protective hood is locked.

Shown in FIGS. 2 and 2*a* is a first position in which the tool spindle 26 is freely rotatable and the protective hood 24 is locked against rotation.

FIG. 2 shows in more detail the bearing arrangement of the tool spindle 26 by means of two bearings 52 and the drive by means of a belt drive 54, of which only the belt 55 can be seen.

At the outer end of the tool spindle 26, the tool 22 is clamped in place between an outer flange 23 and a mating flange 25.

The construction and the functioning of the actuating device 32 are explained in more detail below.

The actuating device 32 has a slide 34 which is displaceably guided in the radial direction of the tool spindle 26 between two guide webs 35. The slide 34 is preloaded in a direction away from the tool spindle 26 by a spring 42 embodied as a compression spring and bears from inside against a wall of the housing 20 in the first position shown in FIGS. 2 and 2*a*, said wall being defined by the aperture 21. The spring 42 is guided and secured in position on a mandrel 44 between a spring receptacle 40, which is accommodated on the housing 20 in a fixed position, and the actuating button 56 (cf. FIG. 2*a*). The slide 34 is made of plastic in one piece with the actuating button 56 and the mandrel 44, for example as a plastic injection moulding, and has, as can be seen in FIG. 2, a roughly rectangular outline.

Accommodated on that end region of the slide 34 which faces the tool spindle 26 is a steel insert 36, from which a first projection 38 projects beyond the outline of the slide 34 in the direction of the tool spindle 26. A lug ring 28 is pressed onto the tool spindle 26 or is secured against relative rotation in another manner. Four lugs 30 which project outwards are provided at equal angular distances apart on the lug ring 28.

Furthermore, a second projection 50 is provided on the slide 34, said projection 50 being offset from the first projection 38 by a certain amount in the direction of the spring receptacle 40 and projecting upwards into the drawing plane in the illustration according to FIG. 2. This second projection 50 is therefore likewise shown hatched in FIG. 2, is of rectangular design and is enclosed by two correspondingly shaped legs of the insert 36. The second projection 50 therefore serves at the same time to fix and position the insert 36 inside the slide 34.

In the position shown in FIGS. 2 and 2*a*, the second projection 50 interacts with an associated recess 46 in the protective hood 24.

Figure 4A:
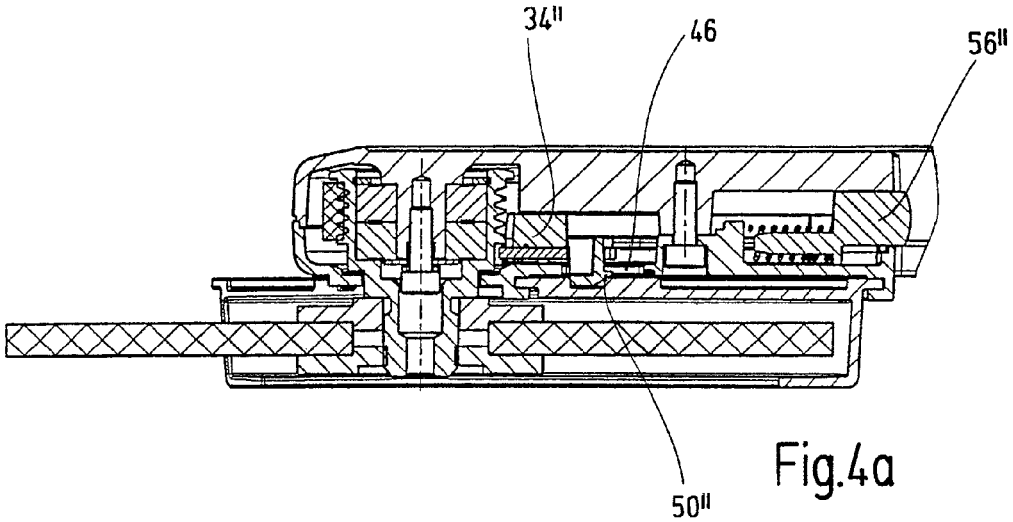
FIG. 4*a* shows a partial cross section of the grinding device according to FIG. 4.
Figure 4:
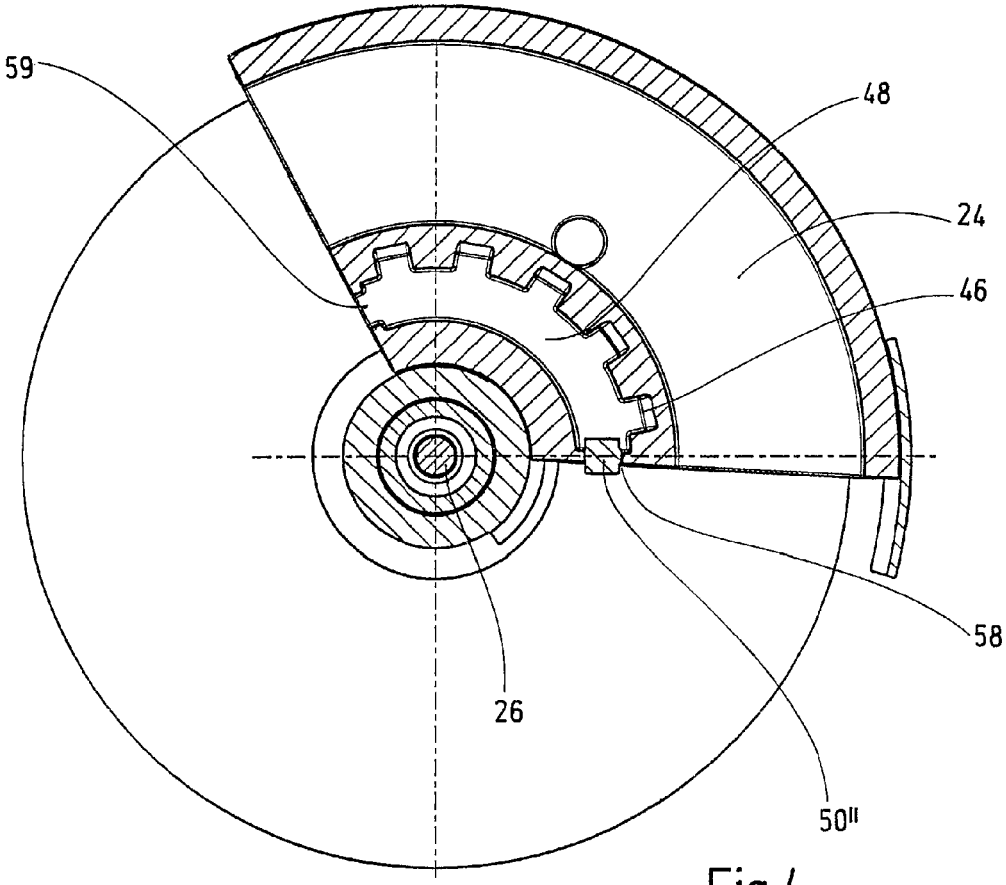
FIG. 4 shows a partial longitudinal section through the grinding device according to FIG. 1, although the extension arm is not shown for the sake of clarity, specifically in a third position in which the protective hood can be removed.
Figure 5:
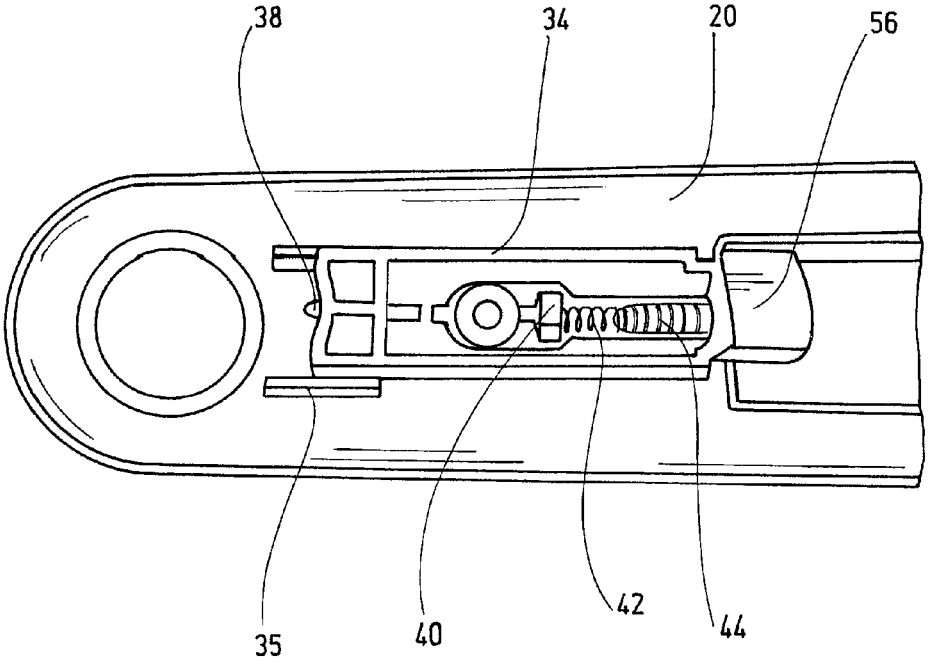
FIG. 5 shows a perspective detailed view of the slide from below, inserted into the top part of the housing and guided on guides.

As can be seen from the illustration according to FIG. 4, the protective hood 24 has a guide lane which is designated overall by 48 and in which a total of five recesses 46, extending radially from the tool spindle 26, are arranged at equal angular distances apart. Furthermore, the guide lane 48 has apertures 58, 59 which are offset radially inwards relative to the recesses 46 and which enable, in an intermediate position, the second projection to move out of the guide lane 48 in the circumferential direction.

In FIG. 4, the second projection is shown in this position by 50" precisely inside the aperture 58 at one end of the guide lane 48.

In the first position, which is shown in FIGS. 2 and 2*a* and in which the slide 34 is located in the end position remote from the tool spindle 26, the second projection 50 engages in one of the recesses 46 in the protective hood 24, such that the protective hood 24 is locked against rotation. In FIG. 2, the associated recess 46 is concealed by the extension arm 18. In FIG. 2*a*, however, it can be seen how the second projection 50, with a lug at the end, engages in the recess 46 and thus locks the protective hood 24. Furthermore, in the first position, the first projection 38 is at a sufficient distance from the lugs 30 of the lug ring 28. The tool spindle 26 is therefore freely rotatable in the first position, while the protective hood 24 is locked by means of the second projection 50.

If the slide 34 is now displaced in the direction of the tool spindle 26 by the actuating button 56 being pushed in against the action of the spring 42, the first projection moves into the position 38' right up to the lug ring 28 of the tool spindle 26 and locks the tool spindle 26 against rotation by bearing against a lug 30. At the same time, the second projection is located in a position designated by 50', and so said projection is released from the underlying recess 46 of the protective hood 24.

The protective hood 24 can therefore be rotated within the guide lane 48 in this second position, in which the tool spindle 26 is locked against rotation.

Figure 3A:
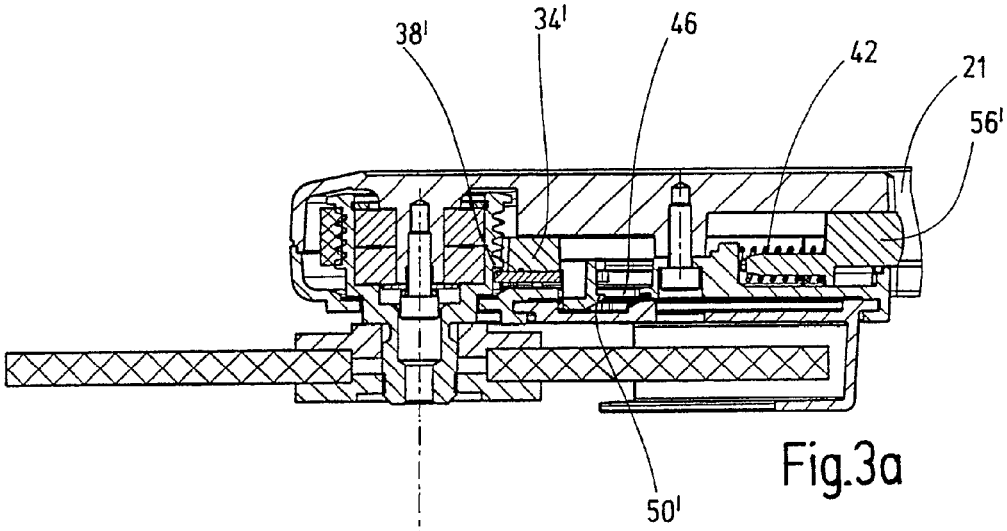
FIG. 3*a* shows a partial cross section of the grinding device according to FIG. 3.
Figure 3:
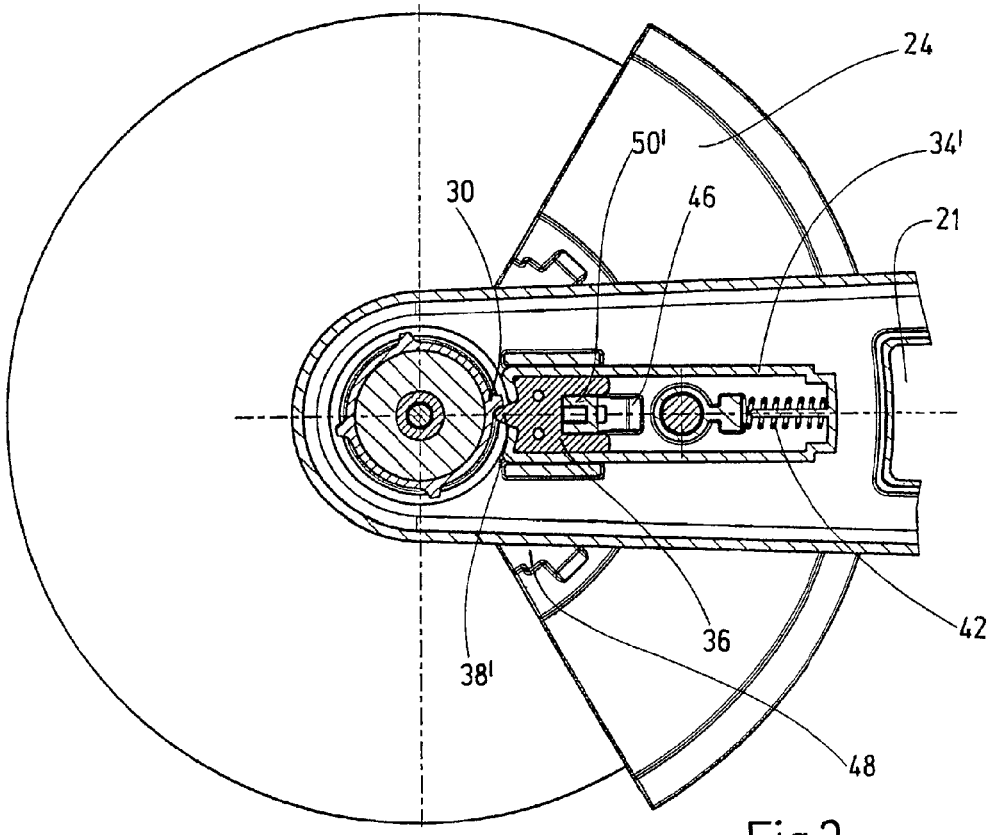
FIG. 3 shows a partial longitudinal section through the grinding device according to FIG. 1 in the region of the tool spindle and of the protective hood, specifically in a second position in which the tool spindle is locked and the protective hood is rotatable.

If the actuating button is released from the position 56' shown in FIGS. 3 and 3*a*, the actuating button moves again under the effect of the spring loading in a direction away from the tool spindle 26, such that the locking of the tool spindle 26 is neutralized and the protective hood 24, with suitable rotation, can be locked with one of the recesses 46 on the second projection 50, such that the first position depicted in FIGS. 2 and 2*a* is again obtained.

The intermediate position briefly mentioned above, namely the third position, in which it is possible to release the protective hood 24 from the housing 20, is now shown in FIGS. 4 and 4*a*. In this third position, the slide is located in an intermediate position designated by 34", which is reached by appropriate actuation of the actuating button 56". In this intermediate position, the second projection lies in an intermediate position, designated by 50", between the first position and the second position, such that the second projection is in alignment either with the one aperture 58 at the one end of the guide lane 48 or with the second aperture 59 at the other end of the guide lane 48. The protective hood 24 can therefore be moved out of the second projection 50" by a further rotation with the guide lane 48 and can therefore be released and removed from the housing 20.

To this end, a marking is expediently located on the actuating button 56, said marking indicating how far the actuating button 56 has to be pushed in in order to reach this third position 56" in which removal and fastening of the protective hood 24 is made possible.

What is claimed is:

1. A grinding device, comprising:

a housing;

a tool spindle received within said housing for driving a tool;

a protective hood which can be locked on said housing;

a locking arrangement engaging said tool spindle or said protective hood for selective locking;

an actuating device arranged on said housing displaceably between a first position and a second position, wherein said tool spindle is released and said protective hood is locked against rotation when being in said first position, and wherein said tool spindle is locked against rotation and said protective hood can be angularly adjusted relative to said housing when being in said second position;

wherein said locking arrangement comprises a slide which is arranged on said housing displaceably between said first position, in which said slide engages said protective hood for locking said protective hood against rotation, while said tool spindle is released, and said second position, in which said tool spindle is locked against rotation and said protective hood can be adjusted angularly on said housing;

wherein said slide comprises a first projection which, when being in said second position, is configured for engaging said tool spindle for locking said tool spindle against rotation, and further comprising a second projection, said second projection engaging said protective hood for locking said protective hood against rotation, when being in said first position.

2. The grinding device of claim 1, wherein said actuating device further comprises a third position, wherein said protective hood can be released from said housing.

3. The grinding device of claim 1, further comprising a plurality of recesses arranged on said protective hood and cooperating with a second projection, allowing latching of said protective hood in selected angular positions, when being in said first position.

4. A grinding device, comprising:

a housing;

a tool spindle received within said housing for driving a tool;

a protective hood which can be locked on said housing;

a locking arrangement engaging said tool spindle or said protective hood for selective locking;

an actuating device arranged on said housing displaceably between a first position and a second position, wherein said tool spindle is released and said protective hood is locked against rotation when being in said first position, and wherein said tool spindle is locked against rotation and said protective hood can be angularly adjusted relative to said housing when being in said second position;

wherein said actuating device comprises a slide which is arranged on said housing displaceably between said first position, in which said slide engages said protective hood for locking said protective hood against rotation, while said tool spindle is released, and said second position, in which said tool spindle is locked against rotation and said protective hood can be adjusted angularly on said housing.

5. The grinding device of claim 4, further comprising at least one locking element on said tool spindle for engaging said first projection for locking said tool spindle in said second position.

6. The grinding device of claim 4, wherein said slide comprises a first projection which, when being in said second position, is configured for engaging said tool spindle for locking said tool spindle against rotation, and further comprising a second projection, said second projection engaging said protective hood for locking said protective hood against rotation, when being in said first position.

7. The grinding device of claim 6, further comprising a plurality of recesses arranged on said protective hood and cooperating with said second projection, allowing latching of said protective hood in selected angular positions, when being in said first position.

8. The grinding device of claim 7, wherein said first and second projections project from said slide in different directions.

9. The grinding device of claim 4, wherein said slide is biased into said first position.

10. The grinding device of claim 4, further comprising an insert arranged on said slide made of a strengthened material, and wherein said first projection is formed on said insert.

11. The grinding device of claim 4, wherein said slide is made of plastic material, and wherein said second projection is formed integrally with said slide.

12. The grinding device of claim 4, wherein said slide further comprises an actuating button which can be actuated from outside via an aperture arranged within said housing.

13. The grinding device of claim 4, wherein said actuating device further comprises a third position, intermediate between said first and second positions, wherein said protective hood can be released from said housing in said third position.

14. The grinding device of claim 13, further comprising:

a guide lane arranged on said protective hood;

a plurality of guide lane recesses projecting radially outwardly from said guide lane; and at least one aperture arranged on said guide lane, said aperture allowing releasing of said guide lane from said second projection upon rotation of said protective hood into a selected angular position, in which said aperture registers with said second projection, for removing said protective hood when said slide is in said third position.

15. The grinding device of claim 4, further comprising guides arranged on said housing for engaging said slide, said guides allowing displacing said slide radially with respect to said tool spindle.

16. The grinding device of claim 4, wherein said grinding device is configured as a fillet weld grinder.

17. A grinding device, comprising:

a housing;

a tool spindle received within said housing for driving a tool;

a protective hood which can be locked on said housing;

a locking arrangement engaging said tool spindle or said protective hood for selective locking;

an actuating device arranged on said housing displaceably between a first position and a second position, wherein said tool spindle is released and said protective hood is locked against rotation when being in said first position, and wherein said tool spindle is locked against rotation and said protective hood can be angularly adjusted relative to said housing when being in said second position.

18. The grinding device of claim 17, further comprising a belt drive for driving said tool spindle.

19. The grinding device of claim 17, wherein said actuating device comprises a slide which is arranged on said housing displaceably between said first position, in which said slide engages said protective hood for locking said protective hood against rotation, while the tool spindle is released, and said second position, in which said tool spindle is locked against rotation and said protective hood can be adjusted angularly on said housing.

20. The grinding device of claim 19, further comprising a spring for biasing said slide into said first position.

* * * * *